US007350449B2

(12) United States Patent
Franzén et al.

(10) Patent No.: US 7,350,449 B2
(45) Date of Patent: Apr. 1, 2008

(54) COUNTERMASS WEAPONRY

(75) Inventors: Arne Franzén, Karlskoga (SE); Lars-Ake Carlqvist, Karlskoga (SE); Lars Ax, Tullinge (SE); Eje Lantz, Eskilstuna (SE)

(73) Assignee: Saab AG, Linkoping (SE)

( * ) Notice: Subject to any disclaimer, the term of this patent is extended or adjusted under 35 U.S.C. 154(b) by 501 days.

(21) Appl. No.: 10/502,886

(22) PCT Filed: Jan. 15, 2003

(86) PCT No.: PCT/SE03/00043

§ 371 (c)(1),
(2), (4) Date: May 6, 2005

(87) PCT Pub. No.: WO03/064955

PCT Pub. Date: Aug. 7, 2003

(65) Prior Publication Data

US 2005/0235816 A1 Oct. 27, 2005

(30) Foreign Application Priority Data

Jan. 31, 2002 (SE) ..... 0200279

(51) Int. Cl.
*F41A 1/08* (2006.01)

(52) U.S. Cl. ..... 89/1.701; 89/1.7; 42/1.06

(58) Field of Classification Search ..... 89/1.701, 89/1.7, 1.702, 1.703, 14.6; 42/1.06
See application file for complete search history.

(56) References Cited

U.S. PATENT DOCUMENTS

| | | | | |
|---|---|---|---|---|
| 889,644 | A | 6/1908 | Szemerey | |
| 3,800,656 | A * | 4/1974 | Schnabele | 89/1.701 |
| 4,132,148 | A * | 1/1979 | Meistring et al. | 89/1.701 |
| 4,574,680 | A | 3/1986 | Nicodemus | |
| 5,313,870 | A | 5/1994 | Clark | |
| 5,357,841 | A | 10/1994 | Clark et al. | |
| 6,286,408 | B1 * | 9/2001 | Sanford et al. | 89/1.701 |
| 6,971,299 | B2 * | 12/2005 | Franzen et al. | 89/1.701 |

FOREIGN PATENT DOCUMENTS

| | | |
|---|---|---|
| SE | 408091 B | 5/1979 |

* cited by examiner

*Primary Examiner*—J. Woodrow Eldred
(74) *Attorney, Agent, or Firm*—Connolly Bove Lodge & Hutz

(57) ABSTRACT

The subject invention concerns a method and a device enabling said packed countermass material (11) to open up said countermass packagings (10) in relation to the firing of countermass weaponry. The basic concept for the subject invention is, thus, that one near the rear outlet end (12) of a countermass weapon (1) barrel fashion a number of blades (15) to the interior of the outlet that protrude inwardly into the barrel sufficiently so as to cut into said countermass container (10), which is pressed past said blades (15) upon firing said weapon (1).

19 Claims, 1 Drawing Sheet

COUNTERMASS WEAPONRY

Figures 1, 2:
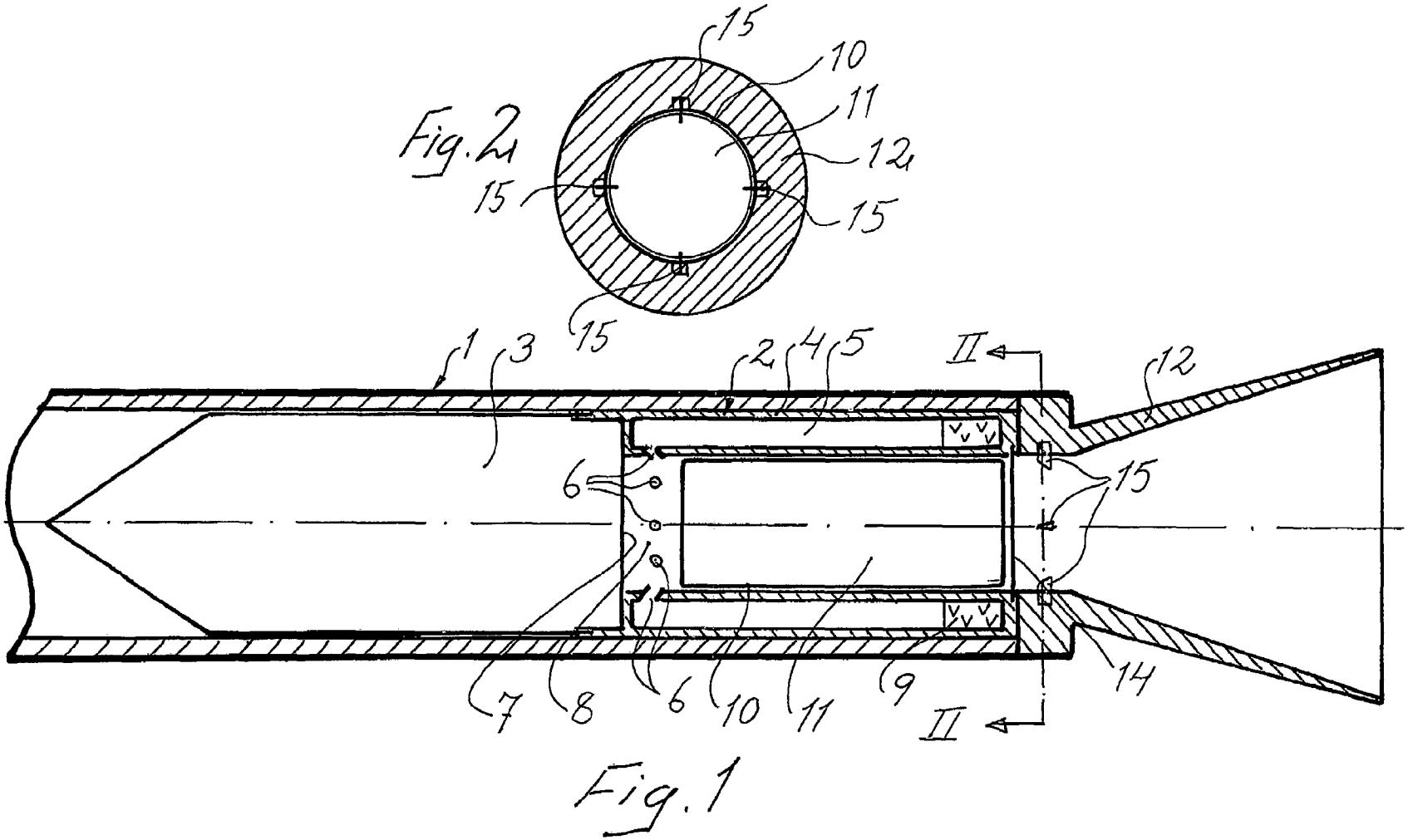

The subject invention concerns a general method of reducing the pressure increase around a fired countermass weapon and countermass weaponry produced in accordance therewith. The weaponry in question can, thus, either be of the reloadable or disposable type. The subject invention has also, by utilising a new type of shell; made it possible to use said reloadable weapons, which would normally function according to the backblast principle, for firing projectiles according to the countermass principle.

A weapon functioning in accordance with the countermass principle, here, means that the recoil resulting from the firing of a projectile is balanced, by a countermass most preferably accelerated in an opposed direction to that of the projectile and preferably from the same barrel. Correspondingly, a backblast weapon regards a weapon whose recoil is eliminated most preferably by a gas outlet in the same said opposed direction, that is, opposed to the direction of fire of the weapon.

There was described, in the simultaneously submitted Swedish patent application (SAP Case 3890 SE), a method and a device for the firing of projectiles according to a modified countermass principle, which affords significantly lower pressure increases around the gunner than what has been customary with similar weapons. This special property that is achieved by utilising a combined high-pressure system and low-pressure system also enables the weapon to be fired from within confined spaces. The basic concept for the high-pressure system and low-pressure system is that the propellant combustion that propels the projectile fired from the weapon occurs in the high-pressure system, from which the propellant gases are drawn off, through thereto-adapted constrictive openings, to the low-pressure system where they propel the projectile in the direction of fire and the countermass in the opposite direction.

If the high-pressure system low-pressure system method, defined in the aforementioned application, is combined with said method according to the subject invention then one can, with reference to that combination, produce disposable as well as reloadable weaponry that afford even lower pressure increases around the fired weapon and, thus, that are distinctively well-suited to be fired from within confined spaces, e.g., from within a house during urban combat or some equivalent thereto.

The method and device, according to the subject invention, are meanwhile not limited only to this combination but can also be used independently in most types of countermass weaponry.

These weapons, according to the invention, thus, have the chief advantage of affording low pressure increases around the gunner. The need for weapons that can be fired from confined spaces has long been known and although there exist today a number of different, in principle, recoilless or reloadable weapons of backblast and/or countermass type, that are both easily handled by a lone gunner and highly effective in-target, it is relatively few of these that combine these properties with the property being able to be fired from confined spaces while maintaining an acceptable range without risk to the gunner.

Over time, much work has been devoted to the selection and consistency of the countermass used in the different types of weapons, because one can state from an early stage that the selection of the countermass affects the pressure increase around the countermass weapon fired as well as the backflash behind the weapon. An additional advantage of countermass is the radically reduced visible heat signature of the weapon due to the extinguishing of the backflash behind the weapon to a greater or lesser extent. In the context of attempting to disperse pressure increases around the gunner, an especial problem has been that one could never accept a reduced pressure increase around the gunner by means of a greater reduction of weapon range and, thus, reducing general usability in the open. A further problem with said countermasses has been that all conceivable countermasses are either fine grained particulate material or have been composed of fluids or some combination of both types. This has entailed that all conceivable countermasses must be packed in the weapon and that these packagings must, in connection with the weapon being fired, open while the packaging must also withstand all other inclement treatment as all other defence materiel until the moment of firing.

Countermasses must be maintained in an appropriate manner until the firing of a given weapon in order to function as a counteragent against the weapon propellant that balances the projectile and thereby eliminates recoil forces that would otherwise affect the weapon. The countermass shall also extinguish the propellant gases, by dispersion there among, and thereby reduce weapon signature and limit the pressure increase around the weapon. The last mentioned function is especially important in the case of one man portable weaponry, as the human body can not withstand large increases of pressure. This problem becomes more accentuated if there is a further need to fire the given weapon from concealed positions within confined spaces, e.g., from within buildings, which thereby often can be cases of "urban combat". In most cases when the countermass contains fluid components it is an inevitable requirement that at least the fluid component is initially completely contained in a sealed container. Initially, it can also be advantageous to have the countermass vacuum sealed, sufficiently rugged and wholly sealed packaging in cases of particulate countermass, considering the handling requirements. An advantage with countermasses that are initially wholly contained in a sealed packaging is that it is relatively easy to fashion a lubrication of the countermass by the propellant gases by drawing off a lesser amount of the propellant gases of the weapon between the inner wall of the barrel and the resistant parts of the countermass container exterior. Thereby on effectively prevents the countermass from jamming, or fastening in the barrel by some other cause. Instead, the problem with well-packaged countermasses becomes one of achieving a sufficiently quick opening of the countermass packaging.

It is often the case that the barrel of disposable countermass weaponry is initially blocked by a "bottom plate" that is equipped with pre-fissured surface. Thus, said bottom plates fracture apart by a predetermined method as soon as the pressure in the weapon rises such that the load against such a said bottom plate exceeds maximum strength of the pre-fissured surface. Bottom plates equipped with pre-fissured surfaces are also customary among shells for reloadable auxiliary backblast weaponry even if the rearwards directed propellant gases are that which rupture the bottom plate. In most cases some method of pre-fissured bottom plate is included in most of the aforementioned systems, even if the countermass is packaged in a wholly sealed casing.

The subject invention concerns a method and a device enabling said packed countermass material to open up said countermass packagings in relation to the firing of countermass weaponry.

The basic concept for the subject invention is, thus, that one near the rear outlet end of a countermass weapon barrel fashion a number of blades to the interior of the outlet that protrude inwardly into the barrel sufficiently so as to cut into said countermass container, which is pressed past said blades by the propellant gases radiated upon firing said weapon. A method of ensuring that the countermass material packaging is displaced past said blades by a pre-calculable method, such that said blades have the possibility of cutting through the packaging material is based upon the propellant gases lubrication being initiated the exterior of said countermass packaging and the interior of said weapon. The simplest means to achieve this should believably be by equipping said countermass material packaging with thin guideways that stretch themselves, protruding outwards in the direction intended for said countermass material to be displaced and bring about a thin strip between the exterior of said countermass container and the interior of said barrel. Presuming that there is such an inclination towards a gap, then the propellant gases shall initially fill the entire gap already prior to the propellant pressure reaching such values that said given projectile and said projectile-balanced countermass begin to move.

A reloadable type weapon for which the subject invention could be relevant for is the renowned M3 recoilless rifle Carl-Gustaf. Said weapon normally functions according to the backblast principle but, by utilising a new type of shell more closely described in the aforementioned Swedish patent application, can also be fire projectiles according to a modified high-pressure low-pressure countermass principle although said weapon in question normally fires projectiles according to the backblast principle.

If said method, according to the subject invention, shall be used in relation to said M3 recoilless rifle Carl-Gustaf and said new type of shell to said weapon, then said weapon must be equipped with blades in the most constrictive part of the outlet nozzle. Said blades upon said weapon can possibly be made retractable because the y shall not be needed when the weapon fires shells that function according to the backblast principle.

Now it is presently the case that this notion of equipping said weapon barrel with blades protruding into the barrel is not entirely new in the weapons area in tended to cut up a package as it is displaced past the blades, but in earlier known weapon proposals in U.S. Pat. No. 889,644 and U.S. Pat. No. 4,040,331 according to the first proposal the intention partly has been to open up grape shot charge and disperse a swarm of bullets, and the second proposal fashion a spherical projectile that converts to a cross-formed projectile with a large area of effect. Even if both of these patents describe said blade devices have noticeable similarities with that which is though to be used in relation to the subject patent, there exists an entire other goal behind the fact that these devices come into use. In both of the aforementioned older inventions, the purpose was to achieve increased hit probability and increased effect in target, while our subject invention, which treats the other end of the weapon barrel, has the task of enduring and bringing about a sufficiently quick opening of the countermass material packaging that shall guaranty the functioning of said weapon. A controlled opening of the countermass material packaging and re-mixing of the countermass material in the air with the combustion gases behind the, in our case, rearwardly open barrel, consequent thereto, entails that one gets control over the flame damping of the expelling propellant gases and a once and for all can experiment until the lowest possible pressure increase around said weapon is achieved.

The subject invention is defined in the subsequent patent claims and is now described in more detail with reference to the illustrations shown in the appended Figure.

Of these,

FIG. 1 depicts a longitudinal section of the rear part of said weapon according to the subject invention and FIG. 2 depicts sections II-II in FIG. 1.

FIG. 1 depicts the rear section of a recoilless rifle, similar to that of the M3 Carl-Gustaf, loaded with a shell 2 containing a projectile 3, of as yet undefined type, and a cartridge casing 4 of the high-pressure low-pressure type. The cartridge casing 4 contains a peripherally devised high-pressure chamber 5 that is equipped with a gas outlet 6, which leads, behind the rear plane of the projectile 7 (seen in terms of the direction of fire), to a low-pressure chamber 8. Further, there is a propellant charge located in the high-pressure chamber 5. Said propellant charge 9 can be initiated with an igniter device (not, here, depicted in the Figure). The low-pressure chamber 8 is limited to the rear plane 7 of the projectile 3 in the initial position, that is to say prior to firing the weapon, in the direction of fire, which is opposed to the direction of the vacuum sealed countermass material 11 in a gas tight container 10. The countermass material packaging is devised as a direct continuation of the low-pressure chamber 8 and is surrounded by the high-pressure chamber 5. As the weapon 1 normally functions according to the backblast principle, its outlet nozzle 12 has a constrictive limit in relation to the barrel diameter. The ring-shaped constrictive area is occupied by the high-pressure chamber, which is why the free area of the low-pressure chamber equals the free area of the outlet nozzle 12. The countermass material packaging 11 is held in place by a bottom plate 14 equipped with a pre-fissured surface. Further, there are four blades 15 (so designated in the subject invention) situated in the most constrictive section of the outlet nozzle 12. FIG. 2 more clearly depicts how the blades 15 are so adapted to incise precisely the exterior container 10 of the countermass material. Said blades 15 can, when necessary, be given a specific design that facilitates the incision of the bottom plate 14 and/or can be utilised to control the outgoing flow of the countermass material when it is release after said incision.

The device depicted in the Figures, thus, function as follows. The propellant 9 ignites upon firing and propellant gases fill the high-pressure chamber 5 and are drawn from there into the low-pressure chamber 8 where said propellant gases accelerate the projectile 3 in the direction of fire, simultaneously as said propellant gases press against said countermass container 10, 11 such that same countermass container presses against said bottom plate 14 and opens said countermass container, thereafter the entirety of said countermass container (earlier designated as countermass packaging) is accelerated out through the most constrictive section of the outlet nozzle 12, where the blades 15 cut into said container 10 and the particulate countermass material is blended with confluent expelling propellant gases.

The invention claimed is:

1. A weapon, comprising:

a barrel having an outlet at a rear of the barrel;

a projectile disposed within the barrel; and a cartridge casing disposed between the projectile and the outlet, the cartridge casing comprising:

a propellant charge; and a countermass; and at least one cutting tool disposed in the barrel to cut through the exterior of the countermass during firing of the weapon.

2. The weapon of claim 1, wherein the at least one cutting tool is disposed at a periphery of an interior of the barrel.

3. The weapon of claim 2, wherein the at least one cutting tool comprises a plurality of blades disposed around a ring-shaped constrictive area of the outlet.

4. The weapon of claim 1, wherein the cartridge casing comprises:

a high pressure chamber, the propellant charge being located within the high pressure chamber; and a low pressure chamber in fluid communication with the high pressure chamber.

5. The weapon of claim 4, wherein the low pressure chamber is disposed between the projectile and the countermass.

6. The weapon of claim 5, wherein the high pressure chamber is in fluid communication with the low pressure chamber via a plurality of gas outlets.

7. The weapon of claim 4, wherein the countermass is disposed within the high pressure chamber and between the low pressure chamber and the outlet.

8. The weapon of claim 4, comprising:

a bottom plate disposed between the countermass and the outlet.

9. The weapon of claim 4, wherein the at least one cutting tool is disposed at a periphery of an interior of the barrel.

10. The weapon of claim 9, wherein the at least one cutting tool comprises a plurality of blades disposed around a ring-shaped constrictive area of the outlet.

11. A method of firing a weapon, comprising:

providing a weapon having a barrel with an outlet at a rear of the barrel, a projectile disposed within the barrel, at least one cutting tool disposed in the barrel, and a countermass; and igniting a propellant charge, wherein the ignited propellant charge displaces the countermass so that the at least one cutting tool cuts through the exterior of the countermass.

12. The method of claim 11, wherein the at least one cutting tool is disposed at a periphery of an interior of the barrel.

13. The method of claim 12, wherein the at least one cutting tool comprises a plurality of blades disposed around a ring-shaped constrictive area of the outlet.

14. The method of claim 11, wherein the weapon comprises a cartridge casing, the countermass being disposed within the cartridge casing.

15. The method of claim 14, wherein the cartridge casing is disposed between the projectile and the outlet, the cartridge casing comprising:

a high pressure chamber, the propellant charge being located within the high pressure chamber; and a low pressure chamber in fluid communication with the high pressure chamber.

16. The method of claim 15, wherein the low pressure chamber is disposed between the projectile and the countermass, and wherein the high pressure chamber is in fluid communication with the low pressure chamber via a plurality of gas outlets.

17. The method of claim 11, wherein the weapon comprises a bottom plate disposed between the countermass and the outlet, and wherein firing the weapon facilitates incision of the bottom plate at the at least one cutting tool.

18. The method of claim 17, wherein the at least one cutting tool comprises a plurality of blades disposed around a ring-shaped constrictive area of the outlet.

19. A weapon, comprising:

a barrel having an outlet at a rear of the barrel;

a projectile disposed within the barrel; and a cartridge casing disposed between the projectile and the outlet, the cartridge casing comprising:

a propellant charge; and a countermass; and means for cutting through the exterior of the countermass during firing of the weapon.

* * * * *